United States Patent [19]

Gardner et al.

[11] 4,120,443

[45] Oct. 17, 1978

[54] CUSHIONING INSERT

[75] Inventors: Jeffrey M. Gardner, Wheaton; Robert E. Beck, Chicago, both of Ill.

[73] Assignee: Container Corporation of America, Chicago, Ill.

[21] Appl. No.: 875,451

[22] Filed: Feb. 6, 1978

[51] Int. Cl.[2] ..... B65D 5/48; B65D 25/04

[52] U.S. Cl. ..... 229/42; 229/15

[58] Field of Search ..... 229/15, 42, 28

[56] References Cited

U.S. PATENT DOCUMENTS

| | | | |
|---|---|---|---|
| 1,475,983 | 12/1923 | Casey | 229/42 X |
| 1,782,915 | 11/1930 | Weidner | 229/42 X |
| 1,860,567 | 5/1932 | Boeye | 229/15 |
| 2,738,917 | 3/1956 | Mader | 229/42 |
| 3,682,367 | 8/1972 | Rohde et al. | 229/15 |
| 4,030,659 | 6/1977 | Gardner | 229/42 |
| 4,077,561 | 3/1978 | Gardner | 229/42 |

*Primary Examiner*—Davis T. Moorhead

*Attorney, Agent, or Firm*—Carpenter & Ostis

[57] ABSTRACT

A paperboard structure for forming an air cell within an outer container to protect the contents thereof.

1 Claim, 4 Drawing Figures

CUSHIONING INSERT

SUMMARY OF THE DISCLOSURE

This information relates to packaging material, and more particularly to an internal structure or spacing device adapted to be positioned within a container adjacent an end wall thereof to provide an air cell for cushioning the contents of the container, such as books or the like.

It is an object of the invention to provide, in a device of the type described, a unitary cushioning or spacing structure which is self supporting and has integral means for maintaining it in proper position after it has been inserted.

A more specific object of the invention is the provision of a cushion or spacing device having a pair of aligned panels which form an inner wall for a container and also having positioning panels and means for maintaining the positioning panels in proper position.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 1:
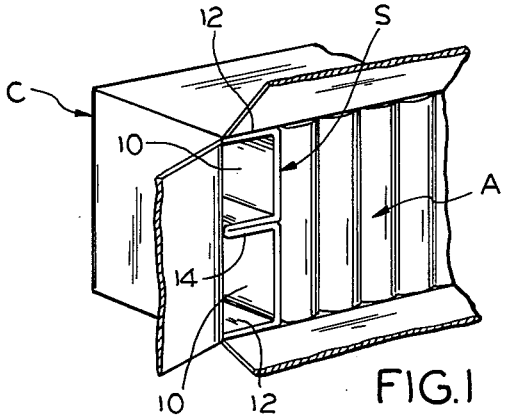
FIG. 1 is a fragmentary perspective view of an outer container holding packaged articles and having positioned therein a cushioning device embodying features of the invention.

Referring now to the drawings for a better understanding of the invention, and particularly to FIG. 1, it will be seen that there is illustrated an outer container, indicated generally at C, in which are packaged a plurality of articles, such as books, indicated generally at A. Also, in order to protect the articles A from damage which may occur in shipping, there is provided at each end of the container a unitary cushioning or space insert, indicated generally at S, and illustrated in detail in FIGS. 2 and 3. Insert S may be formed from the unitary blank B of foldable paperboard illustrated in FIG. 4.

Figure 2:
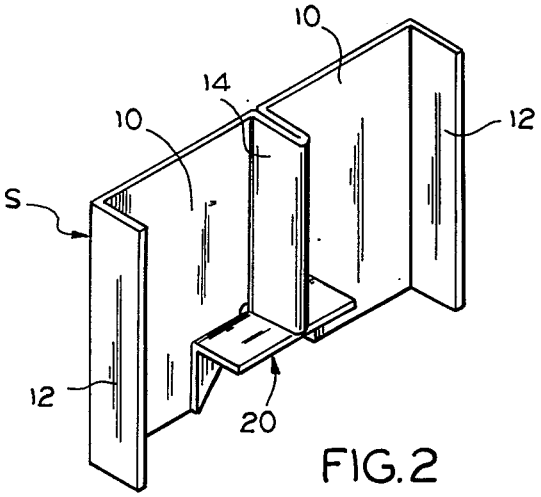
FIG. 2 is a perspective view of the cushioning device or insert illustrated in FIG. 1.
Figure 3:
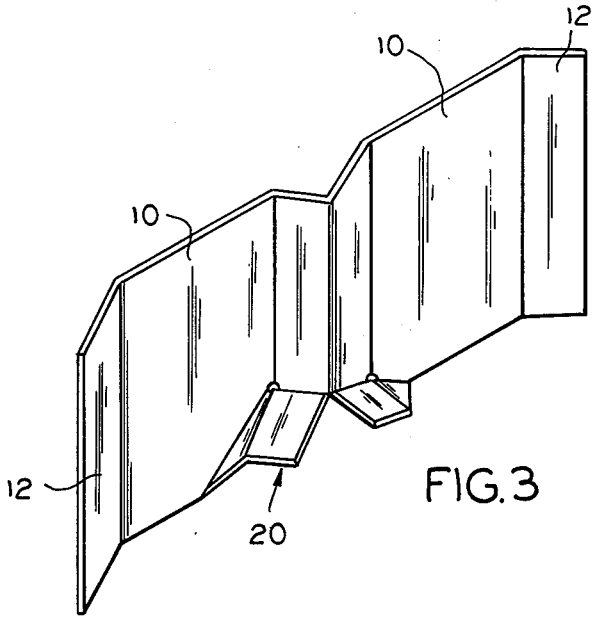
FIG. 3 is a perspective view of the cushioning device of FIG. 2 as shown in a partly erected condition.

Now referring to FIGS. 2 and 3, it will be seen that the cushioning device or insert includes a pair of vertically disposed, co-planar, generally rectangular main panels 10 which are aligned with each other in side by side relation and adapted to be positioned within the outer container C in spaced parallel relation with an end wall thereof. In order to maintain the main panels 10 in proper spaced relation with the end wall of the container, there are provided a pair of relatively narrow side panels 12 and a pair of relatively narrow center panels 14 which extend vertically and are disposed to extend in a direction normal to the main panels 10 between the main panels and the related end wall of the container.

Side panels 12 are foldably joined at their inboard edges along fold lines 13 to the adjacent outer side edges of respective main panels 10.

Center panels 14 are foldably joined at their outboard edges to each other along a fold line 15. Center panels 14 are folded together in face to face relation and have their inboard edges foldably joined along fold lines 17 to the adjacent inner side edges of respective main panels 10.

In order to maintain the center panels 14 in proper position and prevent them from collapsing or being folded out of normal relation with main panels 10, there is provided an integral support member 20 which is located preferably at the lower end of the cushioning device and which is formed from materials cut from the main and center panels of the device.

Support member 20 includes a pair of preferably triangular, vertically disposed flange elements 22 which are joined at lower edges thereof to adjacent lower edges of respective main panels 10 along fold lines 23 which diverge downwardly from center panels 14. Flange elements 22 are folded upwardly 180° about fold lines 23 so as to lie in face to face relation with the adjacent surfaces of respective main panels 10.

Support member 20 also includes a pair of preferably rectangular, horizontally disposed flange elements 24 which are foldably joined at their inboard edges along fold lines 25 to adjacent upper edges of respective flange elements 22 and which are foldably joined at adjacent side edges along fold lines 27 to lower edges of respective center panels 14.

Figure 4:
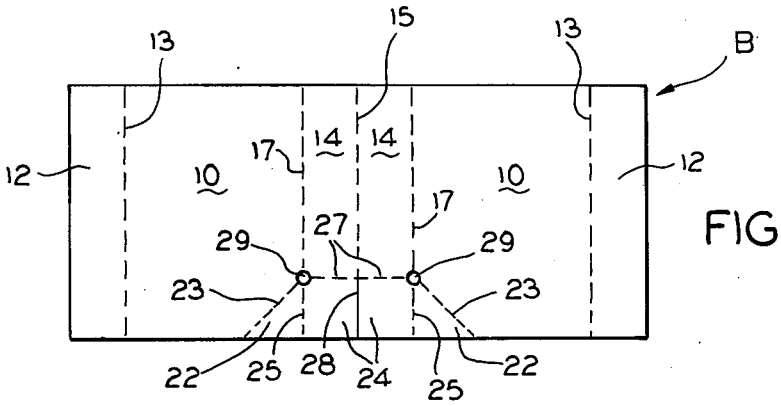
FIG. 4 is a plan view of a blank of foldable sheet material from which the device illustrated in the other views may be formed.

It will be noted from an examination of FIG. 4 that the flange elements 24 are separated from each other by a cut line 28 which is aligned with fold line 15 between respective center panels 14.

Also, because of the thickness of the material used in forming the device, and because of the sharp folds required, the blank may be provided with a pair of holes 29, which are located at the junctures of fold lines 17, 23, 25 and 27, in order to facilitate folding of the paperboard blank to assemble the structure.

Thus, it will be seen that the invention provides a novel spacing device of simple design and construction which includes integral support means for maintaining the device in proper position at all times after it has been inserted in the outer container.

I claim:

1. A cushioning insert, formed of a unitary blank of foldable paperboard, for providing an air cell to protect articles packaged within an outer container having bottom, side and end walls, comprising:

(a) a pair of co-planar, main panels aligned with each other in side by side relation, and adapted to be positioned within an outer container in spaced parallel relation with an end wall thereof;

(b) a pair of relatively narrow side panels foldably joined at their inboard side edges to adjacent outer side edges of respective main panels and adapted to be positioned within an outer container adjacent respective side walls thereof between said insert main panels and a related end wall of an outer container;

(c) a pair of relatively narrow center panels foldably joined at their outboard edges to each other and at their inboard side edges to adjacent inner side edges of respective main panels;

(d) an integral support member for maintaining said center panels in parallel relation with said side panels and in normal relation with said main panels, comprising:

(i) a pair of generally triangular, vertical, flange elements foldably joined at lower side edges to lower edges of respective main panels along downwardly diverging fold lines;

(ii) a pair of generally rectangular, horizontal flange elements foldably joined at inboard side edges to upper edges of respective vertical flange elements and foldably joined at other adjacent side edges to lower edges of respective center panels.

* * * * *